US010639767B2

(12) United States Patent
Maldaner et al.

(10) Patent No.: US 10,639,767 B2
(45) Date of Patent: May 5, 2020

(54) ROLLING UNIT FOR DEEP-ROLLING THE RUNNING SURFACES OF RAIL VEHICLES

(71) Applicant: HEGENSCHEIDT-MFD GMBH, Erkelenz (DE)

(72) Inventors: Jandrey Maldaner, Aachen (DE); Alexander Rudi, Geilenkirchen (DE)

(73) Assignee: HEGENSCHEIDT-MFD GmbH & CO. KG, Erkelenz (DE)

( * ) Notice: Subject to any disclaimer, the term of this patent is extended or adjusted under 35 U.S.C. 154(b) by 287 days.

(21) Appl. No.: 15/511,966

(22) PCT Filed: Sep. 15, 2015

(86) PCT No.: PCT/DE2015/000462
§ 371 (c)(1),
(2) Date: Mar. 16, 2017

(87) PCT Pub. No.: WO2016/041540
PCT Pub. Date: Mar. 24, 2016

(65) Prior Publication Data

US 2017/0282327 A1 Oct. 5, 2017

(30) Foreign Application Priority Data

Sep. 18, 2014 (DE) ..... 20 2014 007 648 U

(51) Int. Cl.
*B24B 39/04* (2006.01)
*B24B 39/06* (2006.01)
(Continued)

(52) U.S. Cl.
CPC ..... *B24B 39/045* (2013.01); *B24B 39/04* (2013.01); *B24B 39/06* (2013.01); *B24B 5/46* (2013.01); *B24B 39/003* (2013.01)

(58) Field of Classification Search
CPC ..... B23P 9/00; B23P 9/02; C21D 7/08; B24B 39/04; B24B 39/06
(Continued)

(56) References Cited

U.S. PATENT DOCUMENTS 2,977,669 A 4/1961 Chambers
3,367,160 A 2/1968 Sperber et al.
(Continued)

FOREIGN PATENT DOCUMENTS

DE 808197 C 7/1951
DE 843822 C 7/1952
(Continued)

OTHER PUBLICATIONS

International Search Report and Written Opinion of the ISA for PCT/DE2015/000462, ISA/EP, dated Mar. 11, 2016.

*Primary Examiner* — Matthew Katcoff
(74) *Attorney, Agent, or Firm* — Harness, Dickey & Pierce, P.L.C.

(57) ABSTRACT

The invention concerns a rolling unit for machining the wheel running surfaces of wheelsets for rail vehicles, with the rolling unit featuring at least one work roller by means of which the wheel running surface to be machined is subjected to a deep rolling process following manufacture of the wheelset in new condition or, at a later date, after reprofiling to increase the service life of the wheel running surfaces. The task is solved to create a relevant rolling unit by means of which the wheel running surfaces can be deep-rolled in the forward feed process using work rollers. This task is solved by the rolling unit featuring a base body on which a support arm is located in a vertical position to the base area, on which a receptacle is supported that is unilaterally fixed in position via a thread in the support arm and on which an angular contact ball bearing is located; this
(Continued)

supports at least one work roller featuring at least two different rolling radii.

14 Claims, 3 Drawing Sheets

(51) Int. Cl.
*B24B 5/46* (2006.01)
*B24B 39/00* (2006.01)

(58) Field of Classification Search
USPC ..... 72/107, 110
See application file for complete search history.

(56) References Cited

U.S. PATENT DOCUMENTS 5,099,558 A * 3/1992 Wilson ..... B24B 39/04 29/90.01
5,220,817 A * 6/1993 Wenzel ..... B21D 22/16 72/83
7,165,430 B2 * 1/2007 Weidmer ..... B21D 15/06 72/102
7,610,786 B2 * 11/2009 Takashima ..... B23P 9/02 72/102
7,862,404 B2 * 1/2011 Takashima ..... B23P 9/02 451/51
10,060,479 B2 * 8/2018 Ai ..... F16C 33/6648
2009/0307886 A1 12/2009 Chiba et al.

FOREIGN PATENT DOCUMENTS

DE 1278274 B 9/1968
DE 2915421 A1 12/1979
DE 4336270 C1 3/1995
DE 202008009833 U1 10/2008

* cited by examiner

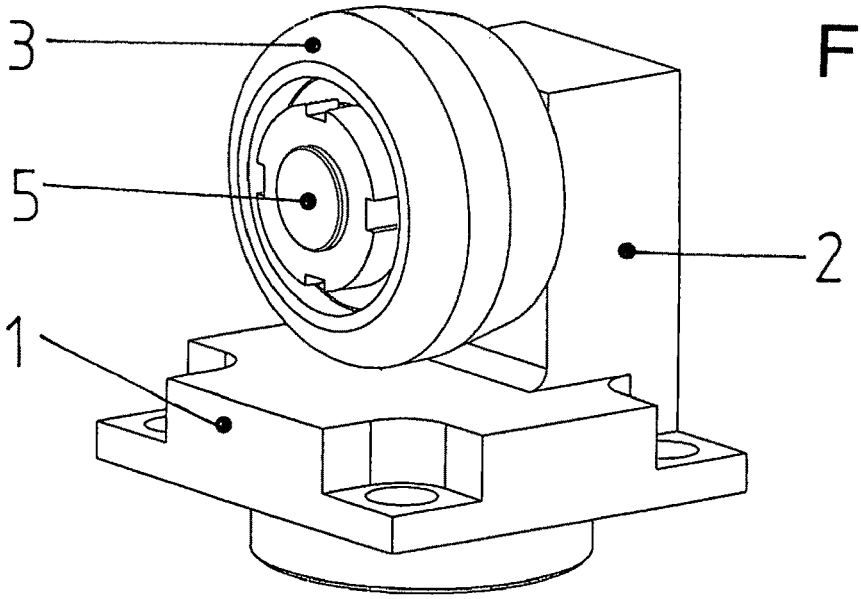
Fig. 1
Fig. 2
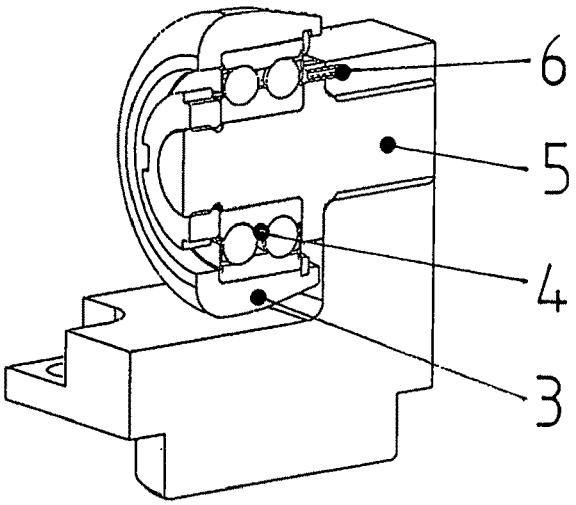
Fig. 3
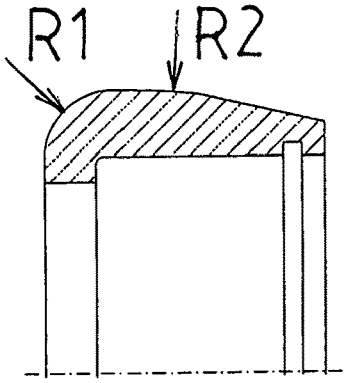

ROLLING UNIT FOR DEEP-ROLLING THE RUNNING SURFACES OF RAIL VEHICLES

CROSS REFERENCE TO RELATED APPLICATIONS

This application is a U.S. National Phase Application under 35 U.S.C. 371 of International Application No. PCT/DE2015/000462 filed on Sep. 15, 2015 and published in German as WO 2016/041540 A2 on Mar. 24, 2016. This application is based on and claims the benefit of priority from German Patent Application No. 20 2014 007 648.0 filed Sep. 18, 2014. The entire disclosures of all of the above applications are incorporated herein by reference.

FIELD

The invention concerns a rolling unit for machining the wheel running surfaces of wheelsets for rail vehicles.

BACKGROUND

Rail vehicles are usually equipped with wheelsets, by means of which a constant contact between vehicle and rail track and thus a safe support and guidance of the respective rail vehicle is ensured. As a result of this rolling contact, the wheelsets are exposed to direct stresses and are safety-relevant for a controlled vehicle movement. Through its interaction with the rail, the geometry of the wheel running surface determines the running of the vehicles. The wheelset is therefore of particular importance in the maintenance of rail vehicles. The high demands on reliability and quality require regular inspection and assessment of the current component state and the available abrasive wear material.

During vehicle movement operation, the wheel-rail system is subjected to different wear mechanisms due to the constant sliding and rolling movements. In addition to the acoustic disturbance for passengers and the surrounding area, the resulting deformation in the wheel running surface profile also poses the danger of material failure for the wheelset and surrounding components, such as the wheel bearing and undercarriage. This problem is to be counteracted and largely avoided by the so-called reprofiling of the wheel running surface profile.

The aim in designing the wheel running surface profile is a safe, low-wear guide ensuring a comfortable ride. For this reason, contours are realized which take into account the natural wear between wheel and rail. In an ideal case, the contours are either not to change at all, or only slightly, during operation of the rail vehicles.

The resulting wear by the removal of material on wheel and rail depends primarily on the friction in the contact zone and the combination of materials. Here, a basic distinction is made between running surface and wheel flange wear. By combining these two wear profiles, a possible wear profile results which is to be reprofiled.

Such a reprofiling can be carried out with machines for wheelset machining, which are known in various type variants, for example as underfloor or surface versions as well as in flatbed and portal designs. By means of machines for wheelset machining, machining processes are used for machining the wheel running surfaces, preferably by turning, so that these machines are also designated as wheelset lathes.

Starting from the understanding that, as a result of introducing residual compressive stresses into the surfaces of rotation-symmetric objects, wear behaviour can be improved, it has already been proposed to subject selected wheelset sections to an additional deep rolling process directly after wheel manufacture in new condition or at a later date following successful reprofiling. In this way an increase in the further service life of the wheel running surfaces can be achieved by deep rolling.

The deep rolling of the surface is a minimally invasive mechanical re-shaping of the edge layer of the component. During this process, suitable rolling elements are guided over the finished component surface under contact pressure. The direct component contact area is plastically deformed while the adjacent contact area is elastically deformed. Depending on the respective actual contact conditions, only the surface is being finished, with minor notches being levelled or the material in the plastically deformed volume is strengthened.

Thus, when deep rolling is used for wheelsets, the work hardening of the wheel running surfaces achieves a finishing or reduction of the surface roughness, a hardening of the boundary layer and an introduction of residual compressive stresses into the boundary area. Any damaging residual stresses present in the edge layer of the workpiece as a result of the pre-machining cutting are eliminated through the re-shaping. By means of the interaction of elastic and plastic deformations a residual stress state advantageous in terms of strength is newly imprinted. Following deep rolling, residual compressive stresses are present in the external boundary layer; these cause a reduction in the wear of the wheel running surfaces or an increase in the mileage of the rail vehicle wheels. This causes the occurrence of any cracks as well as their progression to be significantly restricted. This exclusively mechanical surface treatment by deep rolling is a very effective, environmentally friendly and resource-saving process.

DE 808 197 describes a roller for the deep rolling of axle journals in railway wheelsets. The working surface of this work roller consists of a cylindrical base body. During deep rolling the axis of the work roller runs at an incline to the axis of the axle journal and generates a strung out drop-shaped impression on the surface to be machined. Accordingly, in the area of the impression, deep rolling introduces residual stresses into the surface of the axle journals, by means of which the occurrence of new cracks is to be avoided and/or the further progression of any existing cracks is to be stopped. Deep rolling results therefore in an increase of the service life of a wheelset.

An additional approach for the deep rolling of cylindrical shafts is known from DE 843 822. This device features one or several work rollers. Here, each work roller is supported in a swivelling carrier the swivel axis of which runs vertically to the feed motion of the work roller and approximately vertically to the wheelset shaft.

Using the device for the deep rolling of wear surfaces on the profile of rough-turned wheelsets according to DE 1 278 274, different relative positions can be set between the work roller, its feed device and the wheelset turning axis.

Although from the references mentioned above, as well as additional references on the state of the art, various variants of wheelset shaft sections selected for deep rolling are known, there continues to be a need for further development. This results in particular from the aspect that wheel running surfaces are rolled by the forward feed process which, with regard to component geometry and the feed component, yields very specific requirements for work rollers that cannot be met, or only met to a limited extent, by the embodiments known so far.

SUMMARY

The invention concerns a rolling unit for machining the wheel running surfaces of wheelsets for rail vehicles, the rolling unit featuring at least one work roller by means of which the wheel running surface to be machined is subjected to a deep rolling process following manufacture of the wheelset in new condition or, at a later date, after reprofiling to increase the service life of the wheel running surfaces.

It is the task of the invention to create a rolling unit by means of which wheel running surfaces can be rolled using the forward feed process and work rollers.

This task is solved by the rolling unit featuring a base body on which a support arm is located in a vertical position to the base area, on which a receptacle is supported that is unilaterally fixed in position via a thread in the support arm and on which an angular contact ball bearing is located; this supports a work roller featuring a working surface having at least two different rolling radii.

A modified design provides for the rolling unit having a base body on which a first support arm and a second support arm are supported, that respectively run vertically to the base area of the base body as well as in parallel to one another, with a locating bolt being supported on the support arms, which is two-sided and fixed in position in the support arms by at least one thread, and on which an axial/radial bearing is located which supports a work roller featuring two equal or different rolling radii.

Further advantageous embodiments are dealt with respectively in subordinate claims, the technical characteristics of which are explained in more detail in the following design example.

DRAWINGS

The following items are shown:

FIG. 1 shows a first design of the rolling unit in a perspective view.

FIG. 2 shows the rolling unit according to FIG. 1 in a sectional view.

FIG. 3 shows a detail of a work roller complete with representation of various different radii.

DESCRIPTION

Figure 4:
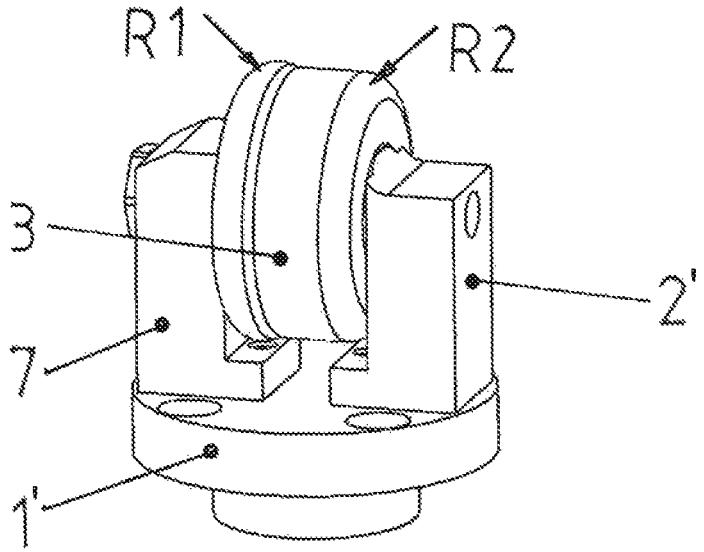
FIG. 4 shows a second design of the rolling unit in a perspective view.

The rolling unit shown in FIG. 1 and FIG. 2 consists of a base body 1 on which, vertically to the same, a support arm 2 is located. The base body 1 and the support arm 2 act functionally as a stopping device on which a work roller 3 is supported.

The cylindrical work roller 3 features a working surface having at least two different rolling radii R1 and R2, that can be seen particularly from FIG. 3. Alternatively, additional rolling radii R3 . . . Rn can also be provided for. For this purpose the rolling radii R1 . . . Rn jointly form a tear-drop-shaped rolling surface in order to be able to generate optimum surface pressures on the wheel running surface during deep rolling. The rolling radii are adapted to the wheel running surface geometry to be rolled. Thus, in the case of the two-part design shown, the rolling radii are between 1 mm and 12 mm in the front or leading area R1 and between 1 mm and 500 mm in the rear or trailing area R2. The work roller 3 can consist of hardened steel or of carbide and has a roll diameter between 20 mm and 200 mm.

In order to ensure a functional rotational movement of work roller 3, this must be supported by a bearing. This bearing support is preferably implemented by means of an antifriction bearing, as by their various different forms antifriction bearings are very adaptable with regard to their application. Antifriction bearings have a high load capacity, they bear high speeds and, in part, are also maintenance-free, inasmuch as for instance they are equipped with lubrication for life and a lip seal. In the proposed application, a two-row angular contact ball bearing 4 is preferably used as an antifriction bearing. Such an angular contact ball bearing 4 provides for a good compromise with regard to construction space and load capacity. In order to further increase the service life of the angular contact ball bearing 4 used and to minimize maintenance, a design with lubrication for life and with sealing lips fitted on both sides is proposed. Alternatively, other variants are possible, for example grooved ball bearings, cylindrical roller bearings or combined axial/radial bearings.

A receptacle or locating bolt 5 supported on support arm 2 is to pass the loads during deep rolling from work roller 3 via the angular contact ball bearing 4 into the stopping device. Due to the type of the angular contact ball bearing 4 this receptacle is designed a cylindrical shaft. The receptacle 5 is unilaterally fixed in position in support arm 2 of the stopping device by means of a male thread at an end of the shaft which engages a female thread in the support arm 2. For a particularly exact fixing in position, receptacle 5 embodies a ring-shaped flange, which becomes effective as a thread stop and simultaneously uses a straight pin 6 to secure the receptacle 5 with support arm 2 in the stopping device against turning out of position. In addition to straight pin 6, the bearing arrangement also features additional components, such as for example retaining ring or slotted nut, which are not provided with any references, however.

Viewed functionally, the stopping device consisting of support arm 2 and base body 1 forms a coupling unit between work roller 3 and processing machine. In place of the existing rotary cutter head for lathe machining, the stopping device can be used or adaptively coupled, next to the rotary cutting head, with the processing machine. Here, the feed traversing distances of the rotary cutter head of the processing machine allow the shutdown of the wheel running surface profile with the work roller 3 of the rolling unit. In this way, the wheel profile can be deep-rolled via the running surface up to the wheel flange cap, so that the construction is excellently suited for relevant machining tasks.

However, if the entire wheel profile, that is the running surface up to the inside wheel flange surface area is to be deep-rolled, this rolling unit must be rotated by 180° in the machine after the first section has been machined. Therefore, a further embodiment is proposed where the roller geometry features a periphery adapted such that the entire wheel profile—running surface, wheel flange radius and wheel flange surface area—can be machined in just one step.

Figure 5:
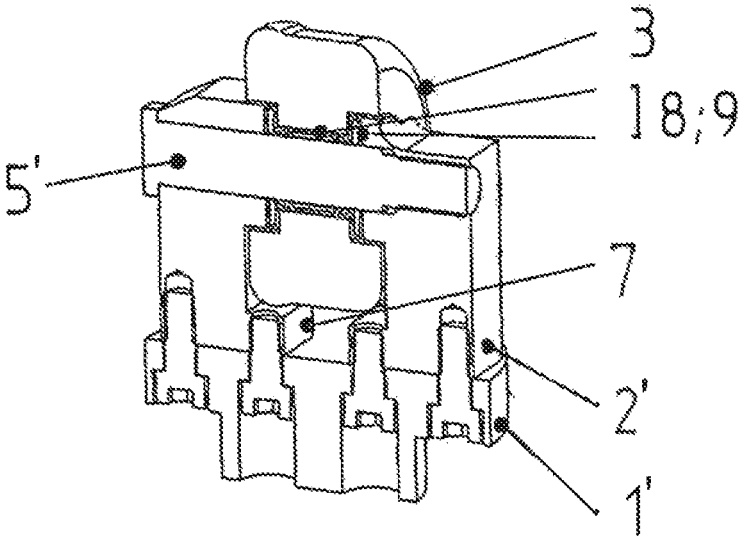
FIG. 5 shows the rolling unit according to FIG. 4 in a sectional view.

The basic setup of a correspondingly modified rolling unit is shown in FIG. 4 and FIG. 5.

This rolling unit also consists of a base body 1', on which a first support arm 2' is located in a vertical position to the same. Furthermore, here a second support arm 7 is provided for, which is also supported on base body 1' and runs in parallel to the first support arm 2'. The base body 1' and the two support arms 2' and 7 act functionally as a stopping device on which a work roller 3 is supported.

The rolling radii R1 and R2 of the cylindrical work roller 3 can be equal; however, they can also differ from one another. These rolling radii R1 and R2 will be adjusted to the geometry of the wheel running surface to be deep-rolled and here are between 3 mm and 30 mm. The work roller 3 can consist of hardened steel or of carbide and has a roll diameter between 20 mm and 200 mm.

For the functional rotational movement of the work roller 3, a combined axial/radial bearing 8-9 is preferably used in the case of this variant. Alternatively, other variants are possible, for example grooved ball bearings, cylindrical roller bearings or slide bearings.

An alternative form of receptacle or locating bolt 5' supported on the support arms 2' and 7 is to pass the loads during deep rolling from work roller 3 via the axial/radial bearing 8-9 into the stopping device. Due to the type of the bearing this receptacle is designed cylindrically. Here, the locating bolt 5' is fixed on two sides via a thread in the stopping device. Two flanges are provided for, in order to take up the axial components of the axial/radial bearing 8-9 and to pass axial forces into the stopping device.

Viewed functionally, the stopping device consisting of base body 1' and the support arms 2' and 7 is the coupling unit between work roller 3 and processing machine. In place of the existing rotary cutter head for lathe machining this stopping device is to be replaced or adaptively coupled, next to the rotary cutting head, with the processing machine for the wheel running surfaces.

Viewed functionally, the stopping device consisting of base body 1 and the support arms 2 and 7 is the coupling unit between work roller 3 and processing machine. In place of the existing rotary cutter head for lathe machining this stopping device is to be replaced or adaptively coupled, next to the rotary cutting head, with the processing machine for the wheel running surfaces.

Figure 6:
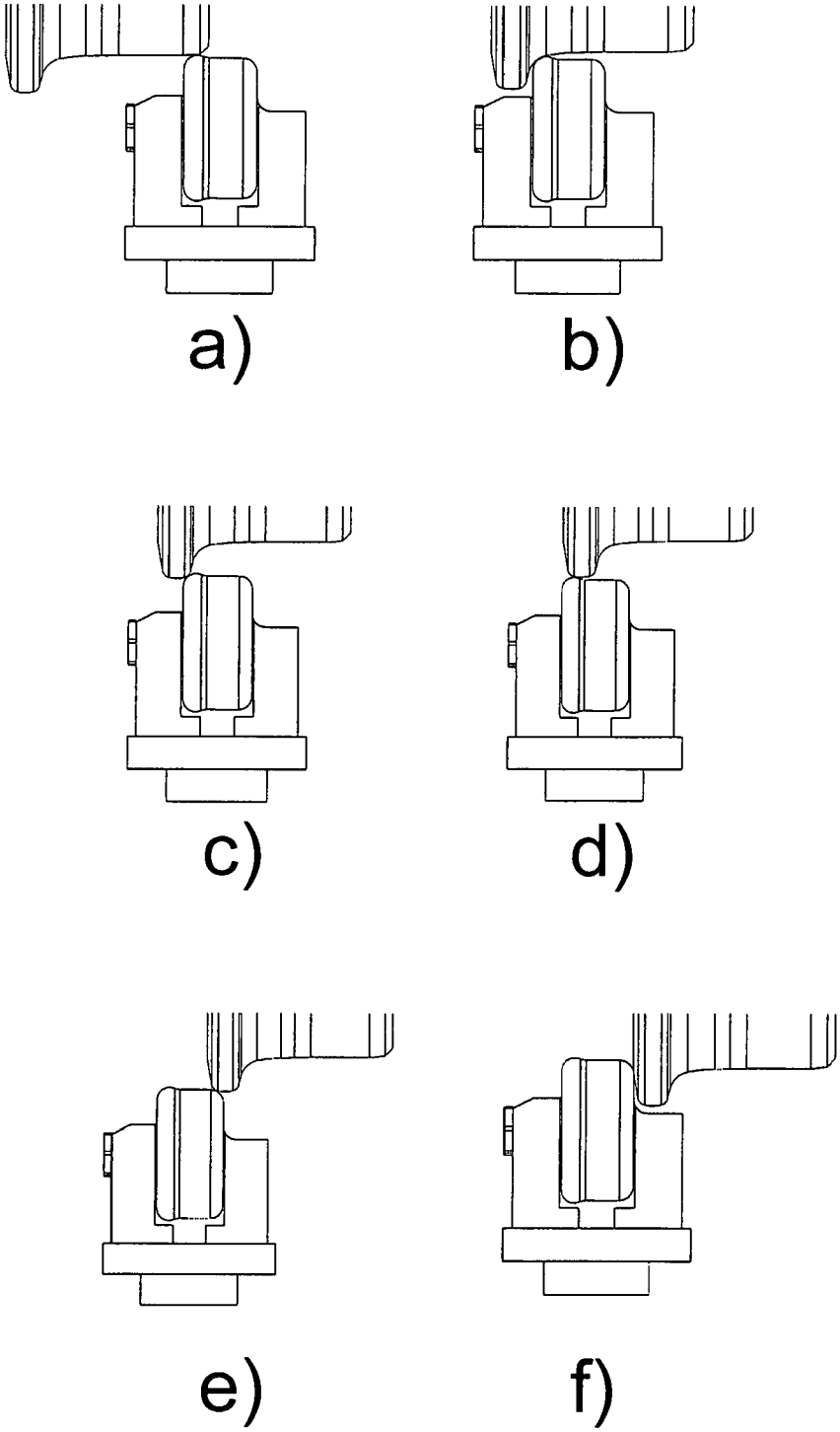
FIG. 6 shows the rolling course along the wheel running surface and the wheel flange radius.

FIG. 6 shows by way of example the rolling course along the entire profile in six positions a) to f). Here, the feed direction of the work roller 3 runs from right to left.

In both embodiments the rolling unit described is suitable for underfloor wheelset lathes as well as for floor wheelset lathes in flat-bed and portal designs. The rolling unit can also be used to machine train wheels in all standard lathes. In addition, this rolling unit can also be used for the machining of forged monoblock wheels in the area of wheel manufacture by vertical wheel machining centres. Thus, the rolling unit in accordance with the invention can be used for the deep rolling of the wheel running surfaces of different types of rail vehicles, from high-speed trains to commuter trains within the railway area, as well as for lighter vehicles such as trams and metros.

The invention claimed is:

1. A rolling unit for machining by a deep rolling process the wheel running surfaces of wheelsets for rail vehicles to increase the service life of the wheel running surfaces, the rolling unit comprising:

a base body;

a first support arm extending vertically upwardly from the base body from a first proximal end to a first distal end, the support arm comprising a female-threaded aperture near the first distal end;

a receptacle comprising a shaft having an unthreaded portion and a male-threaded portion at a distal end thereof, the receptacle supported by the first support arm and fixed in position to the first support arm by engagement of the male-threaded portion with the female-threaded portion;

a bearing mounted on the unthreaded portion of the shaft of the receptacle; and a work roller mounted on the bearing;

wherein the work roller comprises a working surface comprising at least a first arcuate surface portion and a second arcuate surface portion, wherein the first arcuate surface portion comprises a first radius having a first value and the second arcuate surface portion comprises a second radius having a second value which is different than the first value.

2. The rolling unit in accordance with claim 1, wherein the working surface comprises a continuous profile comprising a leading end and a trailing portion, wherein the leading end comprises the first arcuate surface portion and the trailing portion comprises the second arcuate surface portion.

3. The rolling unit in accordance with claim 2, wherein the working surface comprises a tear-drop shape in cross-section.

4. The rolling unit in accordance with claim 2, wherein the first value is between 1 mm and 12 mm and the second value is between 1 mm and 500 mm.

5. The rolling unit in accordance with claim 2, wherein the second value is at least an order of magnitude greater than the first value.

6. The rolling unit in accordance with claim 1, wherein the bearing comprises one of grooved ball bearings, cylindrical roller bearings or slide bearings.

7. The rolling unit in accordance with claim 1, wherein the bearing comprises an angular contact ball bearing comprising two laterally-arranged rows of ball bearings.

8. The rolling unit in accordance with claim 1, wherein the receptacle further comprises a ring-shaped flange disposed between the unthreaded portion of the shaft and the male-threaded portion of the shaft, the flange abutting the first support arm; and wherein the rolling unit further comprises a pin engaging both the first support arm and the flange and being operable to prevent the receptacle from rotating relative to the first support arm.

9. The rolling unit in accordance with claim 1, wherein the work roller has an overall diameter of between 20 mm and 200 mm.

10. The rolling unit in accordance with claim 1, wherein the work roller consists essentially of one of hardened steel or carbide.

11. The rolling unit in accordance with claim 1, further comprising a second support arm extending vertically upwardly from the base body from a second proximal end to a second distal end, the second support arm being spaced apart from and parallel to the first support arm;

wherein each of the first support arm and the second support arm comprises a flange located at their respective distal ends, and wherein the flanges oppose one another;

wherein the receptacle is supported by both the first support arm and the second support arm;

wherein the bearing comprises an axial/radial bearing; and wherein the bearing is laterally constrained between the opposing flanges of the first support arm and the second support arm.

12. The rolling unit in accordance with claim 11, wherein the working surface comprises a leading end and a trailing end, wherein the leading end comprises the first arcuate surface portion and the trailing end comprises the second arcuate surface portion.

13. The rolling unit in accordance with claim 12, wherein the first value is between 3 mm and 30 mm and the second value is between 3 mm and 30 mm.

14. The rolling unit in accordance with claim 13, wherein the second value is an order of magnitude greater than the first value.

* * * * *